US009951519B2

(12) United States Patent
Neil

(10) Patent No.: US 9,951,519 B2
(45) Date of Patent: Apr. 24, 2018

(54) COMPOSITE WALL PANEL, WALL SYSTEM AND COMPONENTS THEREOF, AND A METHOD OF CONSTRUCTION THEREOF

(71) Applicant: Peter Mervyn Neil, Dunsborough (AU)

(72) Inventor: Peter Mervyn Neil, Dunsborough (AU)

( * ) Notice: Subject to any disclaimer, the term of this patent is extended or adjusted under 35 U.S.C. 154(b) by 0 days.

(21) Appl. No.: 15/350,643

(22) Filed: Nov. 14, 2016

(65) Prior Publication Data

US 2017/0218627 A1 Aug. 3, 2017

Related U.S. Application Data

(63) Continuation of application No. 14/005,895, filed as application No. PCT/AU2012/000268 on Mar. 16, 2012, now abandoned.

(30) Foreign Application Priority Data

Mar. 18, 2011 (AU) ..... 2011900961

(51) Int. Cl.
*E04C 2/52* (2006.01)
*E04B 1/16* (2006.01)
(Continued)

(52) U.S. Cl.
CPC ..... *E04C 2/52* (2013.01); *E04B 1/161* (2013.01); *E04B 1/64* (2013.01); *E04C 2/044* (2013.01);
(Continued)

(58) Field of Classification Search
CPC ..... E04C 2/243; E04C 2/044; E04C 2/288; E04C 2/284; E04C 2/28; E04C 2/205;
(Continued)

(56) References Cited

U.S. PATENT DOCUMENTS 1,095,204 A * 5/1914 Golding ..... E04B 5/19 52/321
1,316,136 A * 9/1919 Bevier ..... E04B 5/19 52/324
(Continued)

FOREIGN PATENT DOCUMENTS

FR 2482165 A1 11/1981
FR 2540540 A1 8/1984
(Continued)

OTHER PUBLICATIONS

Supplementary European Search Report for Application No. EP 12 76 1156 dated Jun. 18, 2014.
(Continued)

*Primary Examiner* — Gisele D Ford
(74) *Attorney, Agent, or Firm* — Carlson, Gaskey & Olds

(57) ABSTRACT

A composite wall, ceiling or floor panel (10), system and method, including a sheet (14) having a first face (18) including at least one first mounting portion (16), and at least one formwork member (20) with at least one second mounting portion (30) arranged to engage with the first mounting portion of the sheet to retain the sheet and said at least one formwork member together. Structural support comes from piers (for a wall) or beams (ceiling or floor) formed in the spacing between adjacent formwork members. The formwork members act as the core of a wall, ceiling or floor panel. An external coating (123) is applied to the formwork members, such as spray shotcrete or render. Channels (28) formed by the formwork members defines integrated ducting for services to be run.

34 Claims, 6 Drawing Sheets

(51) Int. Cl.

| | |
|---|---|
| ***E04B 1/64*** | (2006.01) |
| ***E04C 2/04*** | (2006.01) |
| ***E04C 2/32*** | (2006.01) |
| ***E04C 5/07*** | (2006.01) |
| ***E04C 5/01*** | (2006.01) |
| ***E04F 15/02*** | (2006.01) |

(52) U.S. Cl.
CPC ..... *E04C 2/322* (2013.01); *E04C 2/528* (2013.01); *E04C 5/01* (2013.01); *E04C 5/07* (2013.01); *E04F 15/02044* (2013.01); *E04F 15/02155* (2013.01)

(58) Field of Classification Search
CPC ..... E04C 2/2885; E04C 2/324; E04B 5/40; E04B 7/22; E04B 5/026; E04B 5/19; E04B 5/265; E04B 2/02; B29C 44/12; B29C 44/1285
See application file for complete search history.

(56) References Cited

U.S. PATENT DOCUMENTS

| | | | | |
|---|---|---|---|---|
| 1,930,251 | A * | 10/1933 | Navratil | E04B 5/19 52/436 |
| 2,047,109 | A | 7/1936 | Nagel | |
| 4,128,975 | A * | 12/1978 | Abate | B28B 1/084 52/125.4 |
| 4,205,029 | A * | 5/1980 | Forrest | B28B 23/046 264/228 |
| 4,232,494 | A * | 11/1980 | Bauch | E04B 1/32 174/504 |
| 4,655,014 | A | 4/1987 | Krecke | |
| 5,146,721 | A | 9/1992 | Candiracci | |
| 6,247,280 | B1 * | 6/2001 | Grinshpun | E04B 2/8635 52/309.12 |
| 6,817,150 | B1 | 11/2004 | Boeshart | |
| 7,100,336 | B2 | 9/2006 | Messenger et al. | |
| 7,444,788 | B2 * | 11/2008 | Morin | E04B 2/8641 52/425 |
| 7,739,844 | B2 | 6/2010 | Gharibeh et al. | |
| 7,810,293 | B2 | 10/2010 | Gibbar et al. | |
| 7,836,660 | B2 | 11/2010 | Gharibeh et al. | |
| 7,845,138 | B2 | 12/2010 | Groothuis | |
| 7,954,291 | B2 | 6/2011 | Cretti | |
| 8,015,771 | B2 | 9/2011 | LeBlang | |
| 8,161,699 | B2 * | 4/2012 | LeBlang | E04B 1/165 52/252 |
| 8,438,806 | B2 | 5/2013 | Lim | |
| 8,707,645 | B1 | 4/2014 | Boeshart | |
| 8,734,691 | B1 | 5/2014 | Boeshart | |
| 8,763,331 | B2 * | 7/2014 | LeBlang | E04B 1/165 52/252 |
| 2001/0032426 | A1 | 10/2001 | VanderWerf et al. | |
| 2002/0043045 | A1 * | 4/2002 | Marino Del Din | E04B 2/845 52/783.1 |
| 2002/0189182 | A1 | 12/2002 | Record | |
| 2003/0126817 | A1 | 7/2003 | Gleeson et al. | |
| 2005/0262786 | A1 * | 12/2005 | Messenger | E02D 27/02 52/309.12 |
| 2006/0075707 | A1 | 4/2006 | Cretti | |
| 2007/0039266 | A1 * | 2/2007 | Cretti | E04B 5/026 52/340 |
| 2007/0144093 | A1 | 6/2007 | Messenger et al. | |
| 2008/0041004 | A1 | 2/2008 | Gibbar et al. | |
| 2008/0236069 | A1 * | 10/2008 | Hensley | C04B 28/02 52/223.14 |
| 2008/0276559 | A1 | 11/2008 | Messenger et al. | |
| 2009/0199500 | A1 * | 8/2009 | LeBlang | E04B 5/265 52/414 |
| 2009/0293419 | A1 | 12/2009 | Gharibeh et al. | |
| 2010/0269444 | A1 | 10/2010 | Gulbrandsen et al. | |
| 2010/0325993 | A1 | 12/2010 | Bolin | |
| 2013/0014454 | A1 * | 1/2013 | Caboni | E04B 5/19 52/173.1 |
| 2013/0081345 | A1 * | 4/2013 | Sheehy | B32B 13/12 52/425 |

FOREIGN PATENT DOCUMENTS

| | | | |
|---|---|---|---|
| FR | 2569746 | A1 | 3/1986 |
| FR | 2593844 | A1 | 8/1987 |
| FR | 2623227 | A1 | 5/1989 |
| GB | 1007682 | A | 10/1965 |
| NZ | 529310 | A | 2/2005 |
| WO | WO0159227 | A1 | 8/2001 |

OTHER PUBLICATIONS

Extended European Search Report for Application No. EP 12 761 156.4 dated Jun. 25, 2014.

International Search Report and Written Opinion of the International Searching Authority for International application No. PCT/AU2012/000268 dated May 4, 2012.

* cited by examiner

COMPOSITE WALL PANEL, WALL SYSTEM AND COMPONENTS THEREOF, AND A METHOD OF CONSTRUCTION THEREOF

TECHNICAL FIELD

The present invention relates to a composite wall or floor panel, a panel system and a method of construction of a panel and a wall utilising the same, such as for a building.

BACKGROUND

Walls for buildings are typically constructed using either concrete panels raised in situ, single leaves of block, double leaves of brick or block, timber frame with cladding, or a modular insulation panel system attached to a light steel frame. Single leaf block walls, and double leaf brick or block walls are constructed relatively slowly and are labour intensive to build. Timber frame and cladding walls are only suitable for certain types of building and locations, and, like modular insulation panel construction, is typically used for rapid construction, semi-permanent or temporary buildings, and are not designed for industrial or commercial uses.

With economic demands to construct buildings as quickly and cost effectively as possible, tilt up wall panel systems have been developed. These allow sections of precast concrete to be formed, tilted upright and joined together to form a wall of a building. However, such concrete sections are either precast offsite and transported to the construction site for erection, which increases transportation costs and difficulty in handling/maneuvering large, extremely heavy concrete slabs into position with associated risk of injury to personnel and need for heavy lifting equipment, or alternatively, the concrete sections are cast onsite, which can be prone to bad weather delaying the sections drying or damaging the sections as they dry e.g. due to frost or rain. Such sections also need special lifting lugs and heavy lifting equipment to move them into position or tilt them upright. In either case, the solid concrete sections do not provide channels for utilities to pass through or along (vertically or horizontally) and provide little in the way of thermal insulation beyond the normal thermal characteristics of concrete.

At least one alternative form of wall construction for a building involves cutting and assembling framing, placing insulation, fixing an interior lining, fixing or applying an exterior material, and finishing both the exterior and interior surfaces e.g. for painting. This is a relatively complex and involved form of construction requiring many personnel and/or several different types of tradesman to complete the wall.

In addition to the above, existing insulated walling products for buildings may not include an interior lining i.e. a finished surface, nor do they allow for variable sized vertical structural columns to allow for different engineering requirements such as soil loading (foundations), multi-level/storey wind loading and earthquake safety. The vertical columns need to be made thicker and/or wider to accommodate more difficult or demanding ground loading situations, such as where the ground may suffer from instability and for extreme weather or earthquake protection purposes.

With the aforementioned in mind, it is desirable of the present invention to alleviate one or more problems associated with the known art.

SUMMARY OF THE INVENTION

An aspect of the present invention provides a composite wall or floor panel including a sheet having a first face and a second face, the first face including at least one first mounting portion, the panel further including at least one formwork member having at least one second mounting portion arranged to engage with the first mounting portion of the sheet to retain the sheet and said at least one formwork member together.

The sheet may include an insulation layer and a lining layer. The insulation layer may also provide the first face of the sheet. The lining layer may provide the second face of the sheet. Thus, the panel sheet may comprise lamination of insulation and lining layers.

The formwork member may be elongate to extend along a substantial portion of the length or height of the sheet. Alternatively, the formwork member may be intermediate or short in length relative to the length/height of the sheet.

Preferably the lining layer forms an interior lining layer with respect to a building for which the panel is being used for wall construction. This advantageously provides a finished interior lining, such as a board finish, for the building without needing an additional interior lining board being installed. The interior lining layer may be plain board or pre-finished board already coated with a finish and/or texture.

The first and second mounting portions may include respective projections and recesses arranged such that the projections are received into the recesses. The recesses may be provided in the first face of the panel. Likewise, the projections may be provided on the formwork member.

This projection and recess arrangement may include a mechanism to attach the formwork member to the sheet. This may be provided by a keyway arrangement whereby the projection(s) and recess(es) have an inter-cooperating keyway projection and keyway channel locking one to the other.

The formwork member acting as a column section of the panel may have one or more legs projecting from a main body portion. One or more of said legs may include the projection/recess portion for the aforementioned formwork member. Thus, optionally, one or more of the legs may include the corresponding portion of the keyway arrangement of keyway projection and/or channel.

Preferably the body portion of the formwork member includes an exterior surface profile configured to receive and assist retention of a coating. The coating may be a sprayed concrete coating, such as a shotcrete coating, a render or other applied coating, preferably of a cement based material. The profile may include an angular pattern, have undulations, such as peaks and troughs, or have a textured surface, or combinations thereof. Whilst embodiments of the present invention eliminates the need for a mesh covering as part of the applied sprayed concrete coating (preferably having reinforced fibres mixed in), a mesh covering may optionally be provided before the coating is applied if the technical specification required the use of a mesh.

According to one or more embodiments of the present invention, the composite wall or floor panel may combine the insulation layer with a moisture barrier. For example, the insulation layer may inherently have moisture barrier properties or may provide a further layer to the insulation layer. The panel sheet may be a multi-layer laminate of a combination of insulation and moisture barrier layers. The lining layer may be bonded to the panel sheet.

The at least one formwork member may include at least one core channel running along a longitudinal direction of the formwork member(s). Such core channel(s) may advantageously provide one or more voids, such as for service conduits. The void/space between adjacent said formwork members forms variable spacing for vertical concrete columns to create a reinforced (structural) wall after the application of an exterior layer of a hard setting coating such as sprayed concrete or 'shotcrete'. Such an exterior concrete coating is ready for finishing, as is the interior lining.

The void/spaces between the limbs of a specific formwork member may provide for utilities/services to be run between the members, such as water pipes, electric cables, telecommunication cables etc.

One or more embodiments of the present invention avoids the need for a "tilt-up" concrete wall section which requires multiple panel sizes and types of wall panel and/or multiple joints requiring sealing/waterproofing to create a complete wall. A wall can be created with relatively lightweight panel sheets and formwork members connected together, with the required number and size of formwork members and reinforcing dictated by structural specifications, and then coated with concrete to form the finish structural wall. In the case of a floor panel, the floor panel may be pre-formed by putting together the sheet and formwork member(s) and then coating with concrete before placing in situ as a floor panel, or the sheet and the formwork member(s) may be put together and placed in situ as a floor panel and subsequently coated. This latter option may include the floor panel and wall panels being coated in one operation, which can add to the overall strength and also the ease of construction of a building.

A wall may be created by erecting two sets of wall panels with a required or specified space or gap between the formwork sections, creating a void/space into which concrete can be poured/placed to create a reinforced concrete wall which has a lining layer on each side.

The wall/floor panel according to one or more embodiments of the present invention may provide a composite insulated concrete coated wall/floor panel with one or more integral voids for services and utilities. Cabling and pipe work can be run through the void(s) and the concrete coating applied to make the wall panel structurally sound.

Composite insulated concrete wall/floor created according to one or more embodiments of the present invention can simplify the construction of walls and floors for buildings by:

- eliminating skilled tasks (i.e. reducing the need for carpentry or plastering/rendering)
- allowing for less skilled labour utility (rural, youth, indigenous)
- producing more uniform end product
- taking considerably less time for construction than traditional build systems
- allowing for site specific structural requirements to be met by variable core sizes—the panels can be assembled or modified on site prior to coating with concrete
- integrating the thermal insulation, vapour barrier and interior lining
- variable sized core sections that fit into a uniform set of pre-cut recesses (slots) in the panel sheet to create the spaces for reinforced vertical columns, and to create internal voids for services and utilities (i.e. creates conduits for cabling and pipes without the need for separate chiseling or grinding work to 'chase out' a channel in a wall)
- variable sized horizontal cut-outs to create reinforced beams and sills
- panels have application as vertical forms for walls and as horizontal forms for suspended flooring
- lining board fixed to the insulation sheet in factory production process
- ferrous (e.g. steel) or non-ferrous locking plate to align panels and seal conduit voids (from shotcrete)
- extrude a (narrow) EPS panel consisting of the sheet and the core, two of which would then be set side by side and bonded to a lining board to create a full width panel
- reversing the wall/floor panel to have the shotcrete applied as an interior surface (thermal mass) and the laminated lining board becoming the exterior surface is envisaged.

The formwork member provides the underlying shape for the concrete coating to take once applied. Thus, the formwork member dictates the form of concrete columns or piers in the erected and concrete coated panel. The formwork member may also provide stiffening to the panel sheet prior to coating with concrete. It will be appreciated that recesses or channels may be provided in or through the formwork member which create voids or spaces adjacent the panel sheet for running utilities therethrough, such as pipe work, electric cables, telecommunications cables etc.

A further aspect of the present invention provides a method of constructing a structural composite wall or floor, the method including connecting formwork members to a first face of a panel sheet, erecting and supporting the panel sheet and connected formwork members, and spraying the panel sheet and formwork members with concrete, and allowing the concrete to harden.

The formwork members may act to stiffen the panel sheet, and may be structural or the panel may rely on the concrete to harden to provide structural integrity.

The formwork members may have projections inserted into respective channels in the first face of the panel.

A wall or floor of composite panels may be constructed by connecting adjacent erected panels with a locking member spanning adjoining panels. The locking member may be of ferrous or non-ferrous material, such as steel, aluminium, a metal alloy or a plastics material, or combinations thereof.

One or more reinforcing bars may be placed in at least one space/void formed between two formwork members.

A floor panel may be constructed by placing the panel horizontally to create a reinforced floor slab using voids/spaces formed between the formwork members to form a vault structure onto which concrete is poured and leveled.

When the panel is used as formwork to create a suspended floor, that panel becomes the lining of the ceiling of the room below (not the floor), just as in the case of a wall it becomes the wall lining.

DESCRIPTION OF PREFERRED EMBODIMENTS

One or more embodiments of the present invention will hereinafter be described with reference to the accompanying drawings.

Figure 1:
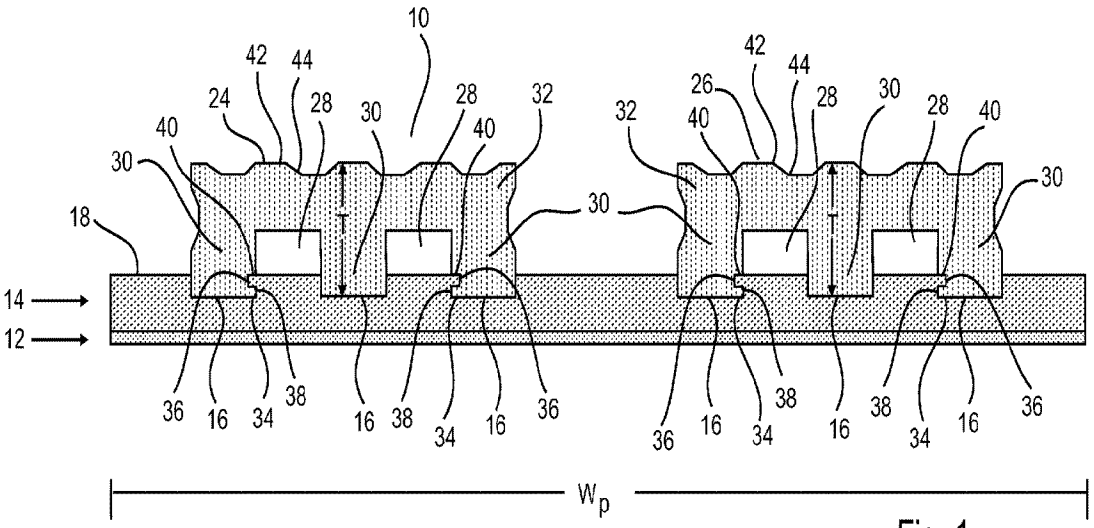
FIGS. 1 and 2 show a section through a wall/floor panel with the panel sheet and formwork member (e.g. column section) connected together according to an embodiment of the present invention.
Figure 2:
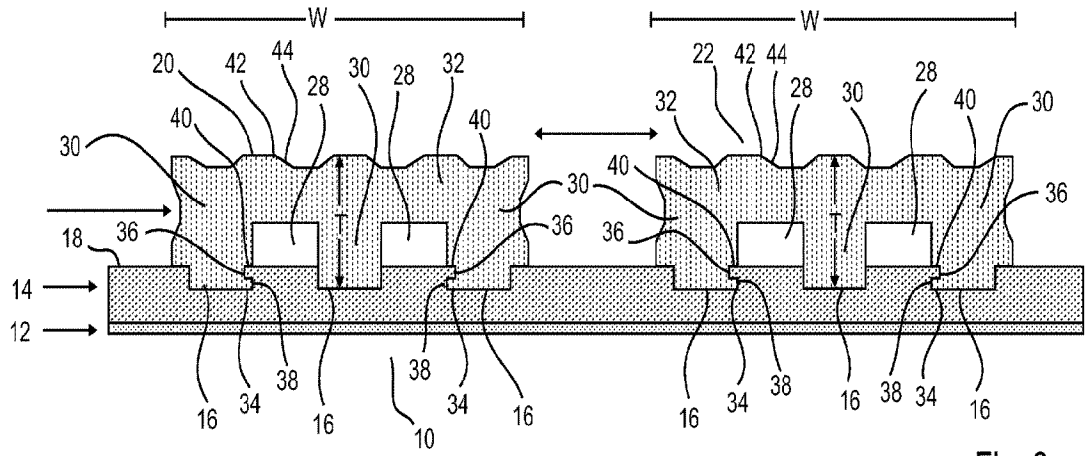

FIGS. 1 and 2 show sections through a panel 10. An interior lining board 12 is bonded, such as by gluing, to a 50 mm thick sheet 14 of insulation material (such as EPS) in a manufacturing facility. The sheet 14 has a uniform series of receiving recesses 16 (such as formwork slots or channels) pre-cut into the first face 18 (forming the exterior face in this embodiment) to receive two core sections 20,22 or 24,26. Embodiments of the present invention may utilise one or more core sections. The required number will vary with the technical specification for a wall or wall panel arrangement. For example, one core section may be used, which may have multiple "legs" 30, or alternatively several narrower core channels may be used having fewer legs. A range of channels 28 in the core sections formed by legs 30 of the core sections allowing the body portion 32 to stand away from the first face 18 of the panel 10 to create "voids" i.e. the channels 28 for services and utilities. These voids also reduce the overall amount of material needed to form the wall panel with minimal or no reduction, if any, in overall strength once coated with concrete. Horizontal channels can be 'pre-cut' or pre-formed in the formwork member (core) sections to form (reinforced concrete) head, sill and/or bond beams. The core section may provide no final strength to the concreted panel as the core creates the shape of the concrete which provides the structural element i.e. the panel provides the "formwork" for the concrete wall.

Legs 16 of the formwork members may include means for retaining the formwork member to the sheet. In the embodiment shown in FIGS. 1 and 2, a 'keyway' arrangement is used. This includes a cooperating projection and channel arrangement, with a leg 16 incorporating a projection 34 and recess 36 each inter-engaging with a respective recess 38 and projection 40 in the sheet face 18. The formwork members are inserted e.g. by sliding, into the channels 16 and the inter-engaging projections and recesses act as a locking 'keyway' to prevent the formwork members from coming back out. Friction between the materials of the sheet and the formwork members (cores) aids retaining these components together.

Overall width W of the formwork column members 20,22,24,26 can be varied to suit particular applications. Likewise, their thickness T can be varied to suit as desired application. Thus, overall strength of the wall/floor panels, particularly when the concrete coating is dried, can be varied to suit structural loading specifications.

The exterior surface of the formwork column members 20,22,24,26 can have a profile or shape to increase surface area in order to improve initial concrete adhesion when spraying the concrete onto the panels. Angular profile sections of peaks 42 and troughs 44, or undulations, or a textured surface, or other shapes may be utilised.

Preferably the lining layer 12 may be a finishing layer of cement based board or plasterboard. The cement based board may be a 2.0-10.0 mm thick sheet, preferably between 4.5 and 6.0 mm, and the plasterboard may be 8.0 mm-12 mm thick, preferably around 10 mm thick sheet.

Figure 3:
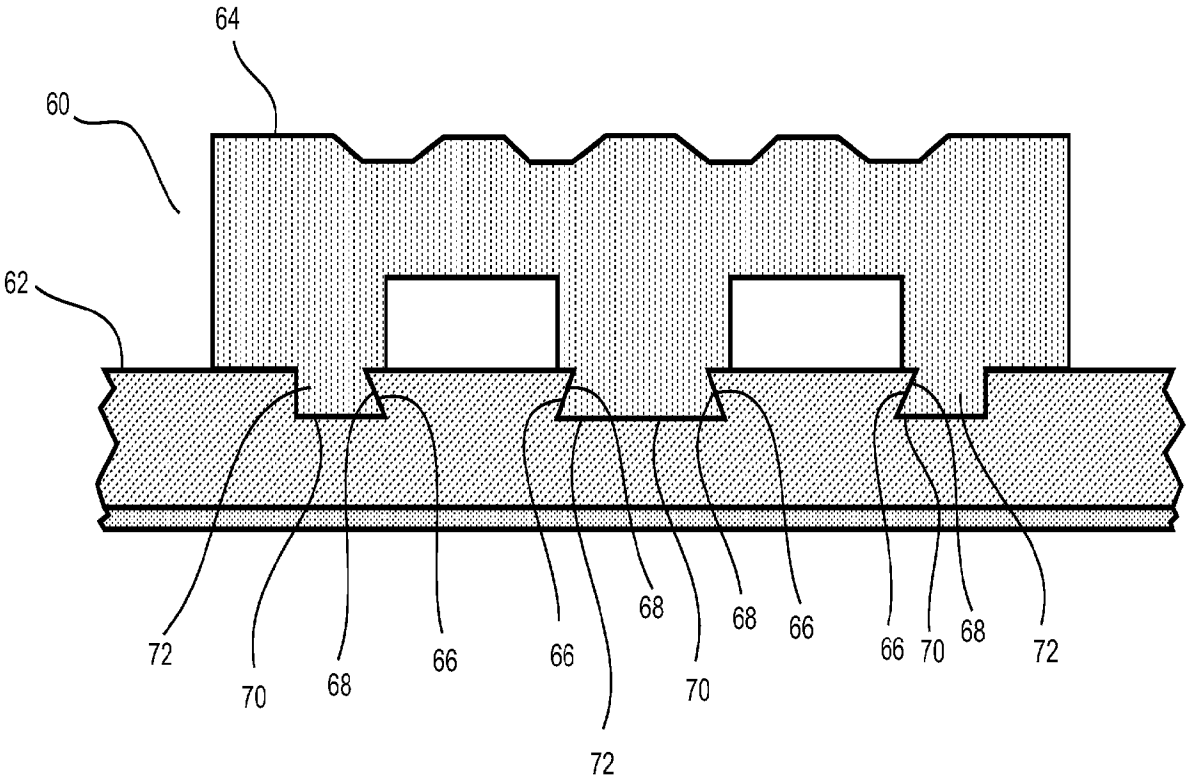
FIG. 3 shows a wall/floor panel according to an alternative embodiment of the present invention.

An alternative form of the panel 60 is shown in FIG. 3. The panel 60 has a sheet material 62 providing a substrate to which is attached a formwork column member 64 (all shown in cross section). Other features are as shown in FIGS. 1 and 2. However, the 'keyway' arrangement has chamfered faces 66 and 68. The sheet 62 has chamfered faces 66 in the channels 70. The formwork column member has chamfered faces 68 on the projections 72 projecting into those channels. It will be appreciated that the projections 72 and the recesses or channels 70 could be reversed such that the formwork column members 64 have the recesses or channels and the sheet has the projections. The projections are preferably slid into the channels. The substrate can be a single material or can be a combination or lamination of materials, such as an insulation material/moisture barrier material with a layer of a finishing material, such as in FIGS. 1 and 2. Preferably the overall width of the panel $W_p$ is a standard trade size, such as 1200 mm or a multiple or fraction thereof, such as 600 mm, 900 mm, 1200 mm, 1500 mm, 2400 mm or 3000 mm etc. The formwork member may preferably be formed of or include expanded polystyrene (EPS) or any material that retains its form as the member. For example, plastic, plant fibre, recycled plastic or rubber waste, metal, plastic coated timber or combinations thereof.

Construction of the panel(s) and use for constructing a building wall will hereinafter be described. The formwork member core sections 20,22,24,26 slide into the pre-cut slots 16 in the first face of the panel, with the completed panels then placed upright on the perimeter of the concrete floor slab/foundation (not shown). A metal locking member, such as a steel or non-ferrous locking plate (not shown) spans adjoining wall panels 10 for alignment. Once the wall panels 10 have been erected, reinforcing bars are placed between the core sections 20,22,24,26 in accordance with the site engineering specification. Horizontal beams can be formed by the pre-cut channels in the core, with head and sill beams framing window and door openings, and a continuous bond beam or beams formed at the top and/or at a specified height in the wall panels. Shotcrete (sprayed concrete) is applied to the exterior of the panels in a continuous process, thereby forming the vertical columns, the horizontal beams and the exterior finished surface creating a reinforced concrete structure.

The composite panel (lined flat sheet plus sized cores) may be placed horizontally to create a reinforced floor slab using the voids between cores and the pre-cut slots (transverse) to form a "honeycomb" or "vault" structure onto which reinforcing is placed and concrete is poured and leveled. This floor slab can then support another set of wall panels to create an extra storey/level.

Figure 4:
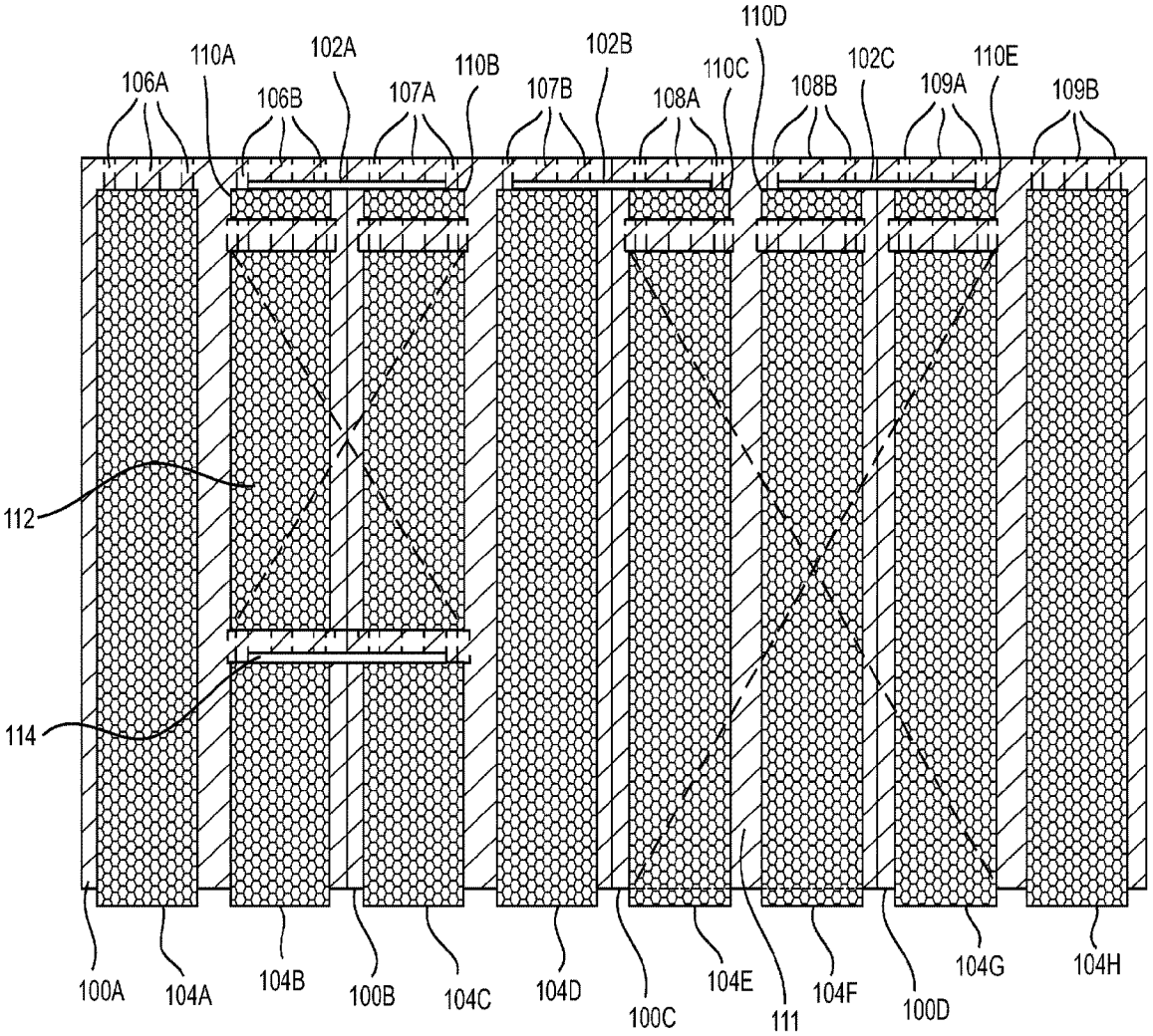
FIG. 4 shows a number of connected panels according to an embodiment of the present invention.

FIG. 4 shows a series of panels 100A-D of the present invention. Adjacent ones of the panels 100A-D are connected together by respective locking members 102A-C. Each locking member can be metallic, such as a formed steel, non-ferrous, alloy or plastics fastener shaped or arranged, with or without other components, to connect into the adjacent panel sheets and/or into the formwork members attached to those sheets and thereby hold the panel sheets together until the concrete has been applied and sufficiently set to give structural rigidity and strength. Put simply, the locking members serve the purpose of holding adjacent panels together until the concrete has sufficiently set. Formwork members 104A-H, the same as or similar to the formwork members shown in FIGS. 1 to 3, are engaged in respective channels 106A . . . n of the panels as previously described. These engaged formwork members provide stability and some rigidity to the respective panel until the panel is coated with concrete and the concrete is sufficiently set. Thereafter, the concrete provides structural strength to specification for the wall.

Door openings 111 and window openings 112 can either be formed in the panels after the formwork members are applied but before the concrete is applied (i.e. the openings may be cut through the panel sheet) or, alternatively, the formwork members are applied in shorter sections to suit the specific panel after the openings have been cut in the panel sheet. Door and window openings may be formed on site (i.e. in situ when the panels are erected) or offsite, (such as at a factory producing the blank panel sheet).

Openings at the top of the formwork(s) at the base of the window opening(s) may be provided with a further locking member 114 that may also block those openings to prevent concrete entering the voids below. This further locking member 114 also connects together adjacent formworks 104B,104C to add strength where the window opening is created. This further locking member may be the same as one of the locking members 102A . . . n.

A corner or junction locking member may be provided to connect panels at that are not directly in a straight line. For example, at a corner, which may be 90 degrees, 45 degrees or other angle, or the panels may be joined to form a generally curved wall approximated by multiple flat panels, or the panels may be pre-curved and connected by curved locking members prior to spraying with concrete.

In use, the required number of panels 100A . . . n are connected together with locking members 102A,B,C . . . etc, as required.

The formwork members provide initial rigidity to the panel but also provide an underlying former such that when the concrete is applied and sets, the concrete forms piers providing structural rigidity and strength to meet a required specification.

It will be appreciated that both faces of the wall may include the formwork member(s) engaged in respective channels on each face of the panel. The formworks may be directly opposite one another or may be staggered. The finished face of each panel may be faced outwards such that the formwork member mounted face of each panel are towards one another. Thus, a cavity is formed between the first faces of each panel having the respective formwork members mounted thereto. Concrete is applied to the cavity to form a solid structure providing sound and thermal insulation, such as for an internal wall between buildings or rooms. Services, such as utilities can be run through the voids formed by the formwork members connected to the respective panel sheet.

Figure 5:
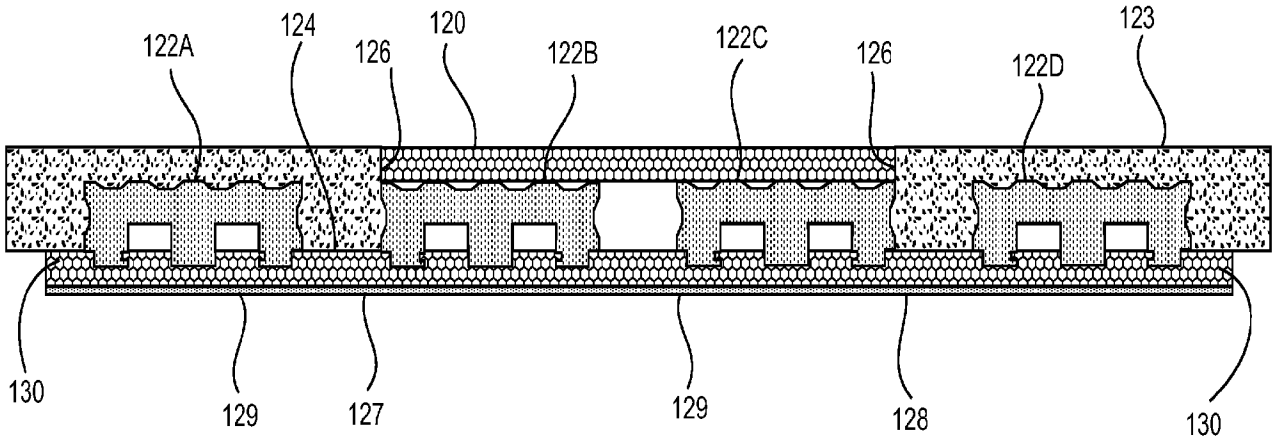
FIG. 5 shows a section through a panel where a window or door opening is to be formed, according to an embodiment of the present invention.

In FIG. 5 there is shown a section through a panel under construction. A window opening or doorway is to be formed in the panel. A subsidiary panel 120, such as a 50 mm thick EPS sheet, is overlaid on selected ones of the formwork members 122A-D. In this example, the subsidiary panel 120 is applied to the central two formwork members 122B and 122C. However, the subsidiary panel, or further subsidiary panel(s), may span further/other formwork members.

Figure 6A:
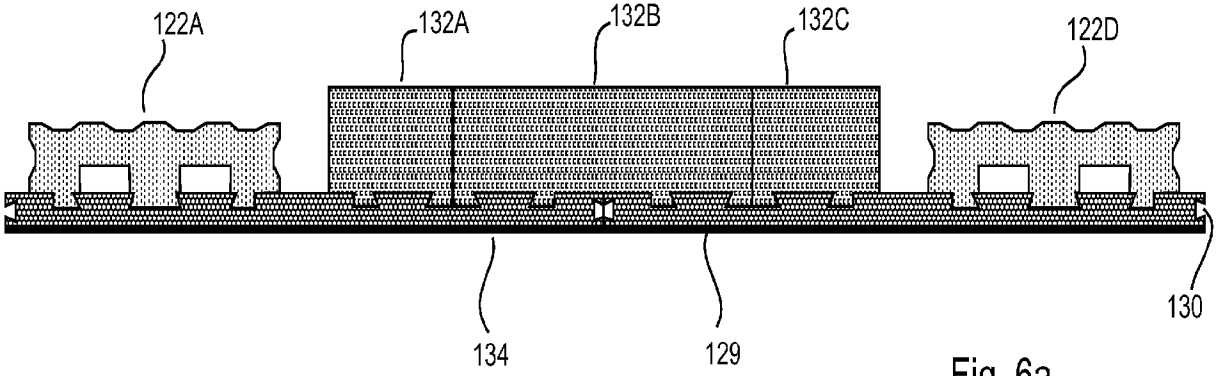
FIGS. 6*a* and 6*b* show sectional views of an alternative form of creating openings in a wall under construction, such as window and door openings, using panels and a system according to an embodiment of the present invention.
Figure 6B:
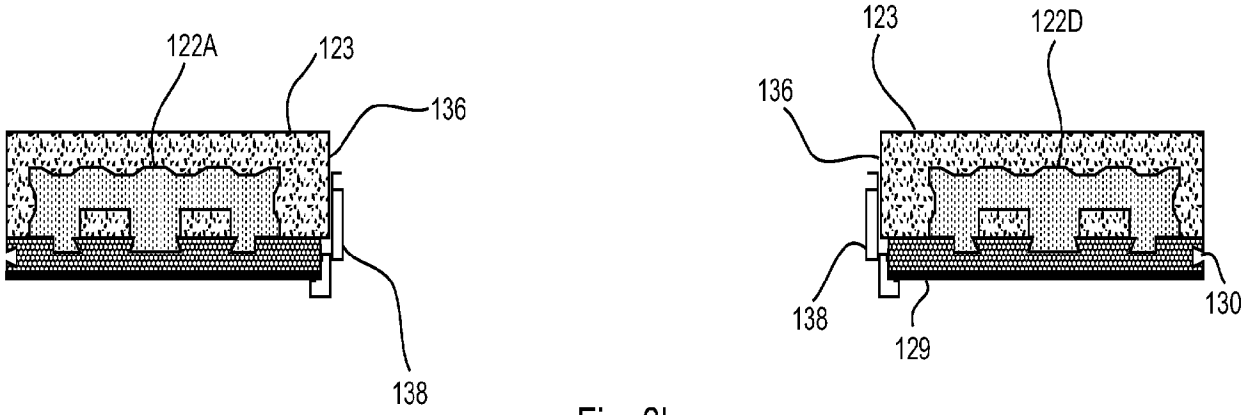

Alternatively, the subsidiary panel may be integral with the formwork member(s) e.g. one piece of EPS foam that, optionally has no internal voids, but retains the projections for inter-engaging with the channels/slots in the panel sheet. Looking at the drawing FIG. 5, this would entail the subsidiary panel 120, and formwork panels 122B and 122C being manufactured or formed as one piece or being single thicker pieces having the same thickness of the subsidiary panel and formwork panel, as shown in FIGS. 6*a* and 6*b*. Such a one-piece component may simplify constructing the panel prior to coating with concrete and avoid potential positioning errors in placing a separate subsidiary panel over separate formwork member(s).

When the concrete coating 123 is applied to the first face 124, the subsidiary panel 120 prevents concrete from coating the covered formwork members, but also provides an edge to coat up to, thereby giving a straight edge and clean window/door reveal 126. The, subsidiary panel, the overlaid formwork members, and the section of panel sheet(s) 127, 128 between the formed reveal(s) 126 may be cut away once the concrete has sufficiently set to create the opening. The panel sheets may include a finishing layer 129 on an outer face of each panel, and an inner facing sheet of material 130, such as EPS, to which the formwork members are attached via an interlocking arrangement as shown in FIGS. 1 and 2.

Each formwork member may be an elongate member (e.g. 104A, 104D, 104H) or may be a relatively short member compared to its width (e.g. 110A, 110B, 110C . . . ), or may be an intermediate length member (e.g. 104B, 104C), or may be formed of multiple shorter member sections connected to form an elongate formwork member. These sections may be bonded together, such as by an adhesive, or may be mechanically joined by one or more connectors or fasteners.

FIGS. 6*a* and 6*b* show a sectional view of two stages of an alternative form of the invention for creating a window or door opening compared to that shown in FIG. 5. Essentially, the formwork members 122B,122C and the subsidiary panel 120 of FIG. 5 are combined into one or more thick formwork members 132A,132B,132C. It will be appreciated that a single formwork member 132 of suitable dimensions to define the required opening measurements (width and height) could be used. As previously described, the formwork panel(s) 'keys' into the inner facing material or other facing sheet or coating, and a final finishing layer 129 may be applied. FIG. 6*a* shows three formwork members keyed into the inner first face 124 of the inner facing material. These formwork members are 150 mm thick (compares with 100 mm thickness of the formwork members 122A-D). The additional thickness helps to support the edges of a coating when applied to the formwork members 122*a*,122D adjacent to the opening to be formed, and makes the door or window reveal the same thickness as the adjacent formwork members plus their coating. These thicker formwork members can thereafter be readily removed with the unneeded out facing over the window or door section to form the opening. FIG. 6*b* shows a concrete coating (such as shotcrete) covering the formwork members 122A and 122D and forming the 150 mm reveal 136 of the window opening. The thicker formwork members 132A,132B and 132C have been removed along with the unneeded facing section 134. Window frame members 138 are shown against the reveal 136 to finish the opening.

Figure 7:
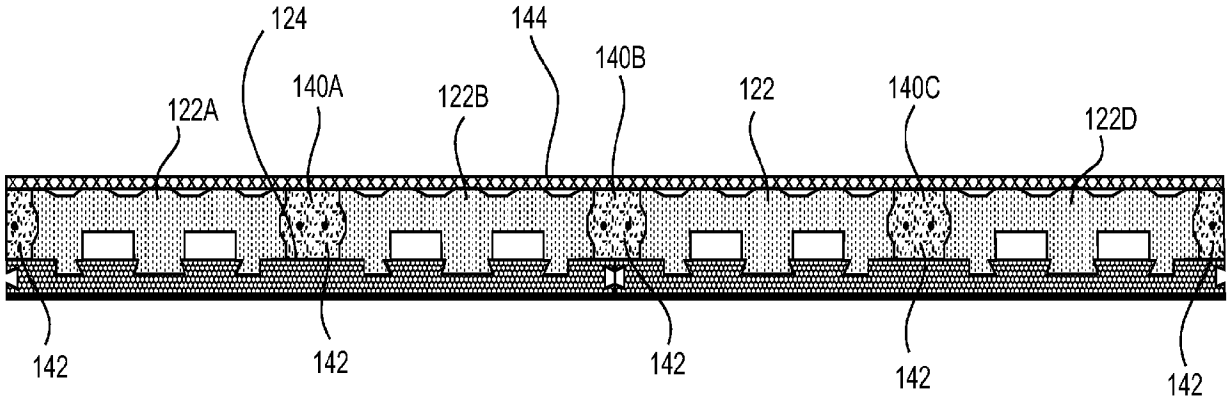
FIG. 7 shows a sectional view of an alternative embodiment of the present invention with formwork members defining gaps to create concrete piers, and a separate coating applied.

In FIG. 7, formwork members 122A-D are keyed into a first face 124 of a facing material, such as by a tongue and groove arrangement previously described. The formwork members are laterally spaced relative to one another and thereby define gaps, 140A,140*b*, 140C and so on. Those gaps provide spaces to form supporting piers 142, such as by using concrete. FIG. 7 makes clear that the coating material 144 is separate to the piers. The coating material can be an applied concrete mixture (such as shotcrete), a render coating with or without a pre applied support mesh, metal or plastic sheeting (such as corrugated sheeting), or a series of panel (e.g. gypsum, cement or wood based sheets) which may be fastened directly or indirectly to the formwork members and/or to the concrete piers, or combinations thereof.

The invention claimed is:

1. A composite wall system for use in forming a composite wall, the composite wall system comprising at least two panels, each of the panels including a sheet and at least one formwork member, each of the sheets having a first face and a second face, the first face including at least one first mounting portion, the at least one formwork member including at least one second mounting portion arranged to engage with the first mounting portion of the sheet to retain the sheet and said at least one formwork member together, the first and the second mounting portions including an arrangement of inter-cooperating preformed projections and recesses such that the preformed projections on the at least one formwork member are received into the preformed recesses in the sheet when the sheet and said at least one formwork member are assembled together to form the panel, the arrangement of the preformed projections and recesses engaging together such that the at least one formwork member and the sheet remain positively engaged together when the respective panel is erected upright for use in forming the composite wall;

wherein the at least one formwork member has limbs extending from a body portion, the preformed projections being provided on the limbs and arranged to engage with the respective recesses set at predetermined spacing, such that at least one void is created between the body portion and the sheet; and a material applied to a space defined between adjacent said framework members, the applied material forming at least one structural pier of the composite wall in the space between the adjacent formwork members.

2. The system according to claim 1, wherein the at least one of the sheets includes an insulation layer and a lining layer.

3. The system according to claim 2, wherein the insulation layer also provides the first face of the respective sheet and the lining layer provides the second face of the respective sheet.

4. The system according to claim 1, wherein the at least one formwork member acts as a column section of the panel.

5. The system according to claim 1, wherein the body portion has an exterior surface profile configured to receive and assist retention of a coating on the body portion.

6. A system according to claim 1, wherein at least one of the second faces includes a lining layer.

7. The system according to claim 1, wherein the at least one formwork member includes at least one of a complex exterior profile or a textured surface to increase surface area for adhesion of the material.

8. The system according to claim 1, wherein the sheets include a moisture barrier material.

9. The system according to claim 1, wherein the at least one formwork member includes the at least one void running along a longitudinal direction of the at least one formwork member, the at least one void having at least one open end.

10. The system according to claim 9, wherein the at least one void provides one or more service/utility conduits.

11. The composite wall system of claim 1, including multiple said formwork members arranged to define a window opening or a door opening.

12. The composite wall system of claim 1, wherein one of the at least one of the formwork members provided of thicker depth than an adjacent one of said formwork members, the thicker depth being for the material to abut to form edges of an opening when the thicker depth formwork member is removed.

13. The composite wall system of claim 12, wherein the opening provides a door or window opening.

14. A composite wall including at least two composite wall systems of claim 1, wherein adjacent said panels of the at least two composite wall systems are connected together by at least one locking member.

15. The system of claim 1, wherein the recesses extend along a length of the sheet;

and the void provides a service or utility access void within the panel along the length of the sheet.

16. The system of claim 1, wherein the projections are dovetail projections and the recesses are dovetail recesses to respectively receive the dovetail projections, or the projections and recesses are a keyway arrangement comprising keyway projections and keyway channels, and the projections and the recesses lock together the at least one formwork member and sheet.

17. The system of claim 1, wherein each of the sheets has a length and a width;

the length is greater than the width, the recesses extend along a substantial portion of the length of the sheet, the projections each extend along a substantial portion of a length of a respective one of the recesses, and the projections each engage at least two different surfaces of the respective recess along the substantial portion of the length of the respective recess.

18. The system of claim 1, wherein each of the sheet has a length and a width;

the length is greater than the width, the recesses extend along a substantial portion of the length of the sheet, the projections each extend along a substantial portion of the length of a respective one of the recesses, and there are at least three of the projections received into at least three respective ones of the recesses.

19. The system according to claim 1, including the respective at least one formwork member forming at least one head or sill beam or a combination of head and sill beams for framing a window opening or door opening to be provided in the composite panel.

20. The system according to claim 1, including at least one continuous bond beam formed at the top of the composite wall or at a specified height in the composite wall.

21. The system of claim 1, including at least one metal or non-ferrous locking member for connecting adjacent erected said panels.

22. The system of claim 1, including one or more reinforcing bars provided in the space formed between two adjacent said formwork members.

23. The system of claim 1, wherein the first face of at least one of the sheets includes an insulation layer.

24. The system of claim 23, wherein the second face of at least one of the sheets includes a lining layer.

25. The system of claim 1, wherein the material comprises concrete.

26. The system of claim 5, wherein the material also provides the coating.

27. A method of constructing a structural composite wall using at least two panels, each panel having a sheet and at least one formwork member, the method including:

connecting a respective said formwork member to a first face of each sheet by engaging an arrangement of respective projections of the formwork member with channel recesses of the respective sheet relative to one another to positively engage and retain together the formwork member and the sheet of each panel when erected, the channel recesses set at predetermined spacing, and the at least one formwork member having limbs projecting from a body portion, the projections provided on the limbs such that at least one void is created between the body portion and the sheet;

erecting and supporting the sheet and the connected respective formwork members for forming the composite wall;

forming at least one structural pier in a space between at least two adjacent ones of said formwork members by applying a material over at least a portion of the first face of at least one of the sheets between applying a material over at least a portion of the first face of at least one of the sheets between the at least two adjacent ones of said formwork members; and allowing the material to harden to form the composite wall.

28. The method according to claim 27, material comprises concrete.

29. The method according to claim 27, including subsequently connecting adjacent erected panels with a metal or non-ferrous locking member spanning adjoining panels.

30. The method according to claim 27, including placing one or more reinforcing bars in the space between the two adjacent ones of said formwork members.

31. The method of claim 27, including providing one of the at least one of the formwork members with a thicker depth than an adjacent one of said formwork members, the thicker depth providing edges for the material to abut to form edges of an opening when the thicker depth formwork member is removed.

32. The method of claim 31, wherein the opening provides a door or window opening.

33. The method according to claim 27, comprising spraying the material as a coating over at least one of the two adjacent ones of said formwork members.

34. The method according to claim 33, wherein the material comprises concrete.

* * * * *